US010478882B1

(12) United States Patent
Perez

(10) Patent No.: US 10,478,882 B1
(45) Date of Patent: Nov. 19, 2019

(54) CONDUIT MARKING DEVICE

(71) Applicant: Andrew Perez, Salt Lake City, UT (US)

(72) Inventor: Andrew Perez, Salt Lake City, UT (US)

( * ) Notice: Subject to any disclaimer, the term of this patent is extended or adjusted under 35 U.S.C. 154(b) by 360 days.

(21) Appl. No.: 15/584,173

(22) Filed: May 2, 2017

(51) Int. Cl.
*B21D 7/14* (2006.01)
*B21D 7/06* (2006.01)

(52) U.S. Cl.
CPC ..... *B21D 7/14* (2013.01); *B21D 7/06* (2013.01); *B21D 7/063* (2013.01)

(58) Field of Classification Search
CPC ..... B21D 7/063; B21D 7/024; B21D 7/021; B21D 7/16; B21D 7/12; B21D 7/02; B21D 7/022; B21D 7/14; B21D 11/22; B21D 7/04; B21D 7/10; B21D 11/12; B21D 7/00; B21D 11/18; B21D 7/06
USPC ..... 33/485
See application file for complete search history.

(56) References Cited

U.S. PATENT DOCUMENTS 2,887,917 A * 5/1959 Kowal ..... B21D 7/063 72/31.04
3,194,038 A * 7/1965 Small ..... B21D 7/063 72/31.05
4,063,444 A * 12/1977 Vecho, Jr. ..... B21D 7/063 72/459
5,222,384 A 6/1993 Evans
5,669,258 A 9/1997 Luebke
5,681,318 A * 10/1997 Pennig ..... A61B 17/72 606/86 R
5,727,419 A * 3/1998 Walsten ..... B21D 7/063 16/422
6,422,054 B1 7/2002 White
7,624,511 B1 12/2009 Schmidt
D661,381 S 6/2012 Motegi
8,875,411 B2 11/2014 Al-Dhafiri
9,968,976 B2 * 5/2018 Klinger ..... B21D 7/063
2003/0233859 A1 * 12/2003 Luebke ..... B21D 7/063 72/458
2004/0182129 A1 * 9/2004 Hopwood ..... B21D 7/063 72/459
2017/0274437 A1 * 9/2017 Klinger ..... B21D 7/063

FOREIGN PATENT DOCUMENTS

CN 104249365 A 12/2014

* cited by examiner

*Primary Examiner* — Yaritza Guadalupe-McCall
(74) *Attorney, Agent, or Firm* — Kyle A. Fletcher, Esq.

(57) ABSTRACT

The conduit marking device comprises a slotted, marked measuring handle for a conduit bender. The measuring handle may be a replacement for the handle provided with the conduit bender. The measuring handle of the conduit marking device provides the ability to easily measure, mark, and align conduit in order to obtain precise results for the bends. The measuring handle is hollow and tubular and a piece of conduit may be inserted into the measuring handle from one end of the handle. The measuring handle incorporates slots, which allow the conduit to be seen through portions of the handle. Measuring indicia on the measuring handle allow specific locations on the conduit to be located and the locations may be marked through the slots on the measuring handle.

15 Claims, 7 Drawing Sheets

CONDUIT MARKING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of tools, more specifically, a system for measuring and marking the location of bends in electrical conduit.

Electrical conduit is straight, metal pipe or tubing (commonly sold in 10 ft lengths) that is connected end-to-end to form a protective duct for electrical wiring. Typically, a run of electrical conduit starts at an electrical box such as a breaker panel box where it attaches to the box using a special fitting. The conduit then runs along or through walls, rafters, floor joists, and other building structures to another electrical box such as an outlet box or switch box where it again attaches using a special fitting. Since an individual section of conduit is rarely reaches from one electrical box to another using a single piece of conduit, the ends of two pieces of conduit may connect to each other using a special fitting. A typical building may have many such runs of conduit leading between the breaker panels, outlet boxes, switch boxes, lighting fixture boxes, and electrical machinery throughout the building. Once the conduit is in place, electrical wires are pulled through the conduit, wires are cut to an appropriate length to remove excess wire, ends of the wire are stripped, and the wires are connected to electrical components such as circuit breakers, switches, light fixtures, and electrical machinery. As used herein, the word "printed" is intended to mean that a change of coloration was produced using paint, ink, dyes, or other coloring agents; the method of producing such a coloration change may include pens, brushes, stamps, stencils, or other methods of applying a coloring agent.

Because conduit runs are rarely a straight line from one box to another box, it is necessary to bend the conduit in places. Conduit must often turn 90° to change direction from a horizontal run to a vertical run or vice versa. In particular, one type of 90° bend results in a short horizontal or vertical run as the conduit enters an electrical box—this short run is called a stub. Conduit often encounters an offset In the building (meaning a transition from a first planar surface to a second planar surface that is parallel to the first planar surface). Offsets are handled by making two bends of the same angle in opposite directions on the conduit—the distance between the bends in conjunction with the angle used for the bends will determine how much of an offset will be achieved. A conduit bender is a tool commonly used by electrical contractors to bend electrical conduit. Typically a conduit bender comprises a conduit bending head and a handle approximately 3 ft to 5 ft long. The conduit bending head comprises a hook, which wraps around the front, back, and one side of the conduit and pulls the conduit around the bend, a shoe which is a curved channel used to shape the bend, a heel which is used by the operator of the conduit bender to apply pressure during the bending process, and an attachment point for the handle. In addition, the side of the conduit bender head comprises several markings that allow the operator of the conduit bend to achieve a predictable bend. An 'arrow' between the hook and the shoe is a reference point for positioning the bender on a piece of conduit. A 'star' marks the center of a 90° bend. Several angle markings show how far to pull the bender to achieve a shallow bend of less than 90°.

A key aspect of using the conduit bender is to mark the conduit appropriately so that the bender can be positioned accurately to achieve the desired result. Marking the conduit is a fairly complicated process because it must take into account such factors as the diameter of the conduit, the desired length of the resulting stub or offset, the angular degree of bend needed, and the amount of length that will be lost (shrink) or added (gain) due to the geometry of the bend. In addition, marking the conduit requires the use of another tool in the form of a folding rule, tape measure, or some other measuring device.

SUMMARY OF INVENTION

The conduit marking device comprises a slotted, marked measuring handle for a conduit bender. The measuring handle may be a replacement for the handle provided with the conduit bender. The measuring handle of the conduit marking device provides the ability to easily measure, mark, and align conduit in order to obtain precise results for the bends. The measuring handle is hollow and tubular and a piece of conduit may be inserted into the measuring handle from one end of the handle. The measuring handle incorporates slots, which allow the conduit to be seen through portions of the handle. Measuring indicia on the measuring handle allow specific locations on the conduit to be located and the locations may be marked through the slots on the measuring handle.

An object of the invention is to provide a tool for aiding in the measurement and marking of lengths on electrical conduit. Another object of the invention is to provide a tool capable of marking longitudinal sight lines on electrical conduit.

Yet another object of the invention is to allow the conduit marking device to replace the existing handle of a conduit bender.

These together with additional objects, features and advantages of the conduit marking device will be readily apparent to those of ordinary skill in the art upon reading the following detailed description of the presently preferred, but nonetheless illustrative, embodiments when taken in conjunction with the accompanying drawings.

In this respect, before explaining the current embodiments of the conduit marking device in detail, it is to be understood that the conduit marking device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the conduit marking device.

It is therefore important that the claims be regarded as including such equivalent construction insofar as they do not depart from the spirit and scope of the conduit marking device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive. As used herein, the word "electrician" is intended to mean a person involved in any aspect of wiring an electrical circuit, including the aspect of bending and installing electrical conduit; the electrician may, in fact, be an electrical contractor, an electrician, an electrical technician, an electrical apprentice, an electrical engineer, or any other person qualified to perform electrical installation work.

Figure 1:
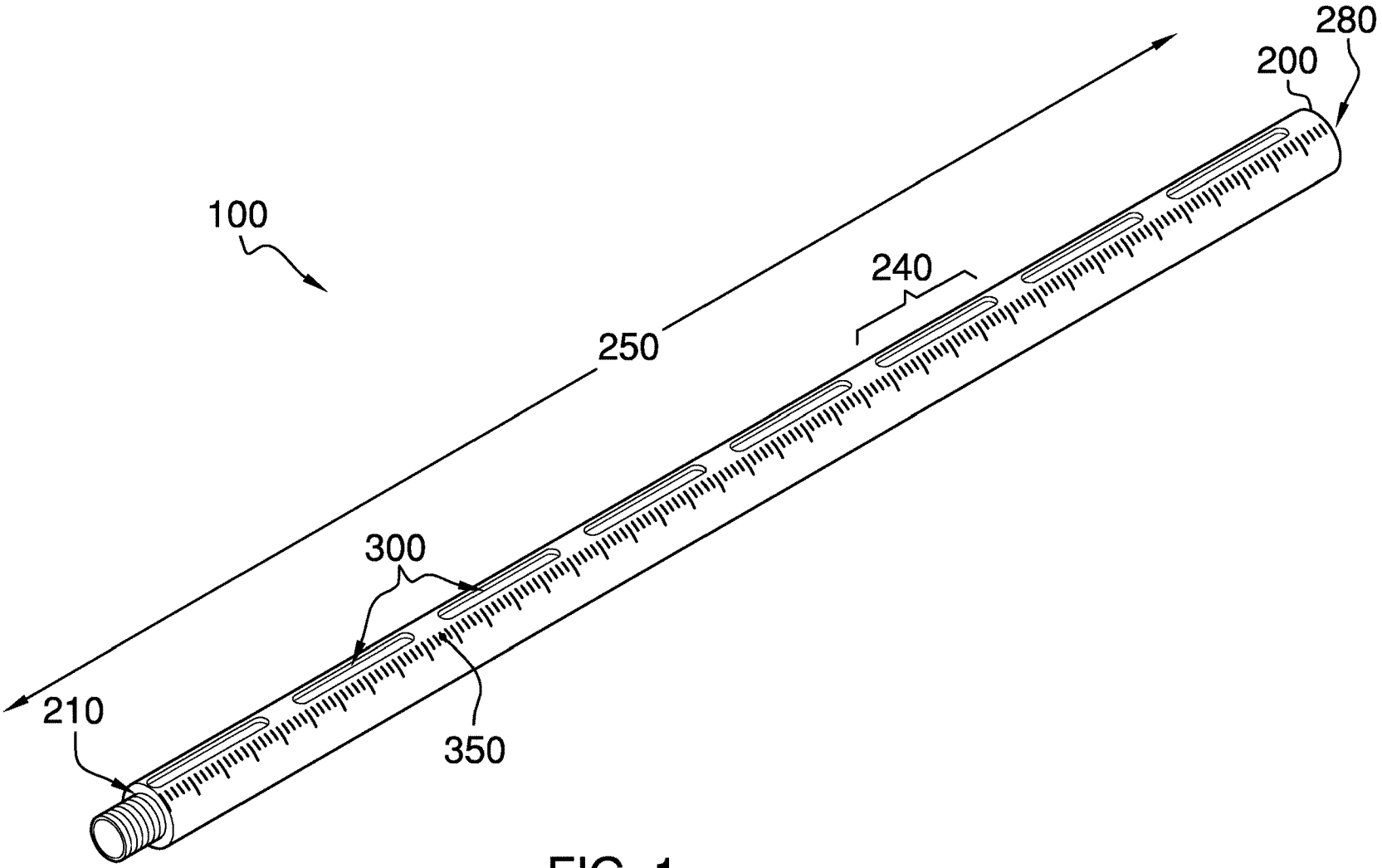
FIG. 1 is a perspective view of an embodiment of the disclosure.
Figure 2:
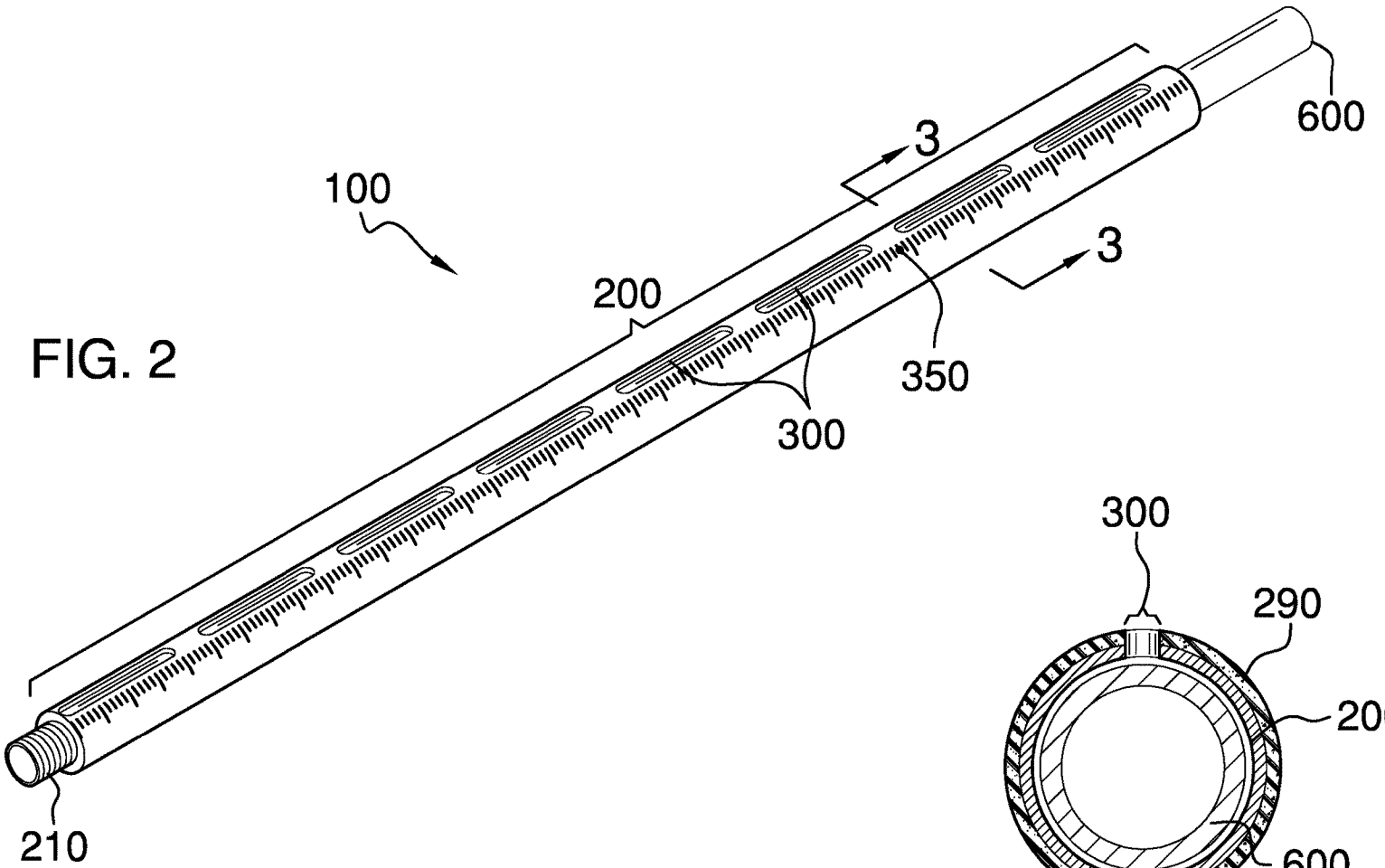
FIG. 2 is a detail view of an embodiment of the disclosure illustrating two handle segments coupled and measuring a piece of conduit.
Figure 3:
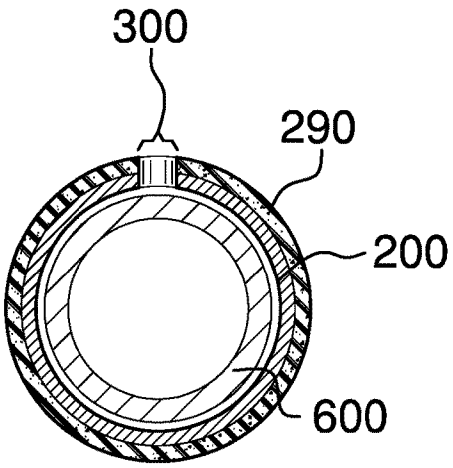
FIG. 3 is a cross-sectional view of an embodiment of the disclosure across 3-3 as shown in FIG. 2.
Figure 4:
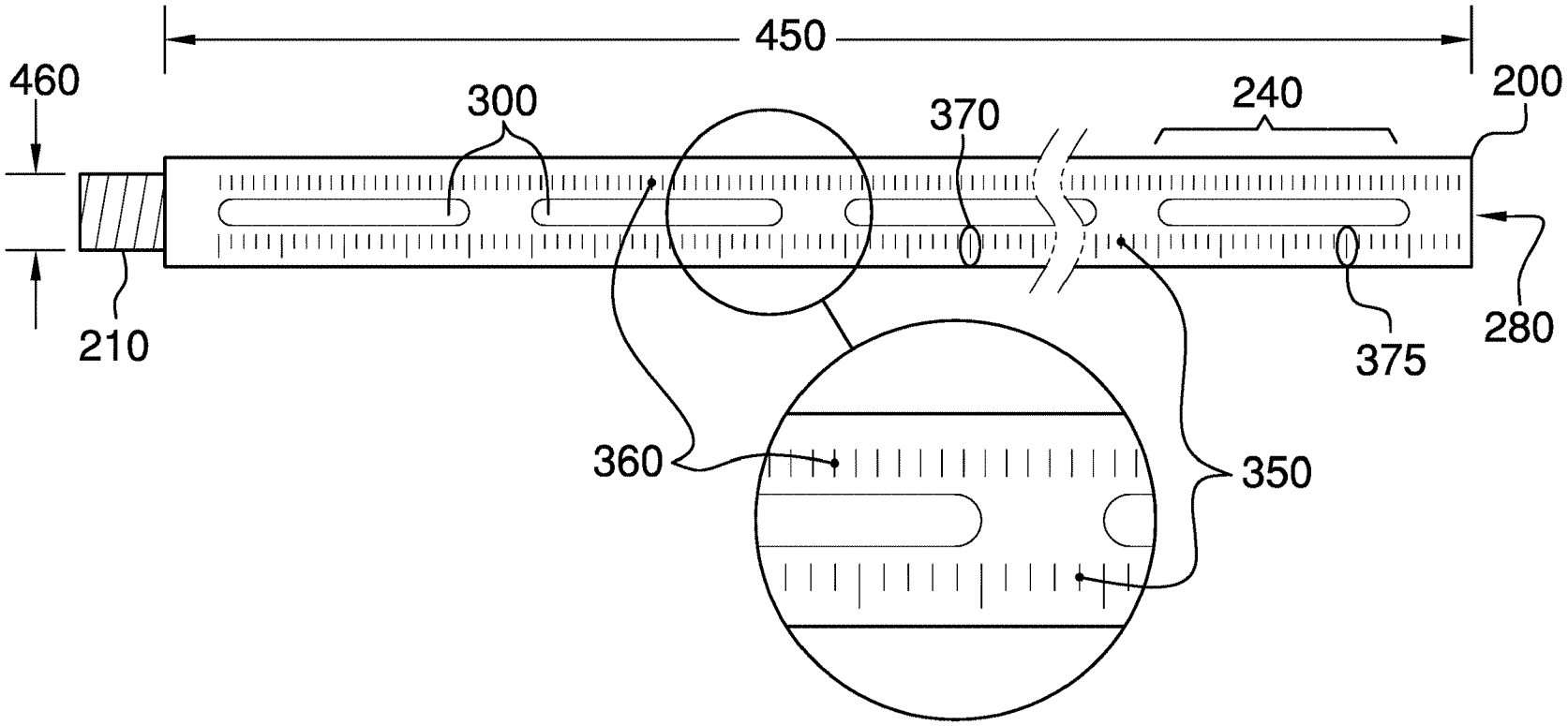
FIG. 4 is a side view of an embodiment of the disclosure showing detail of the integral measuring scale.
Figure 5:
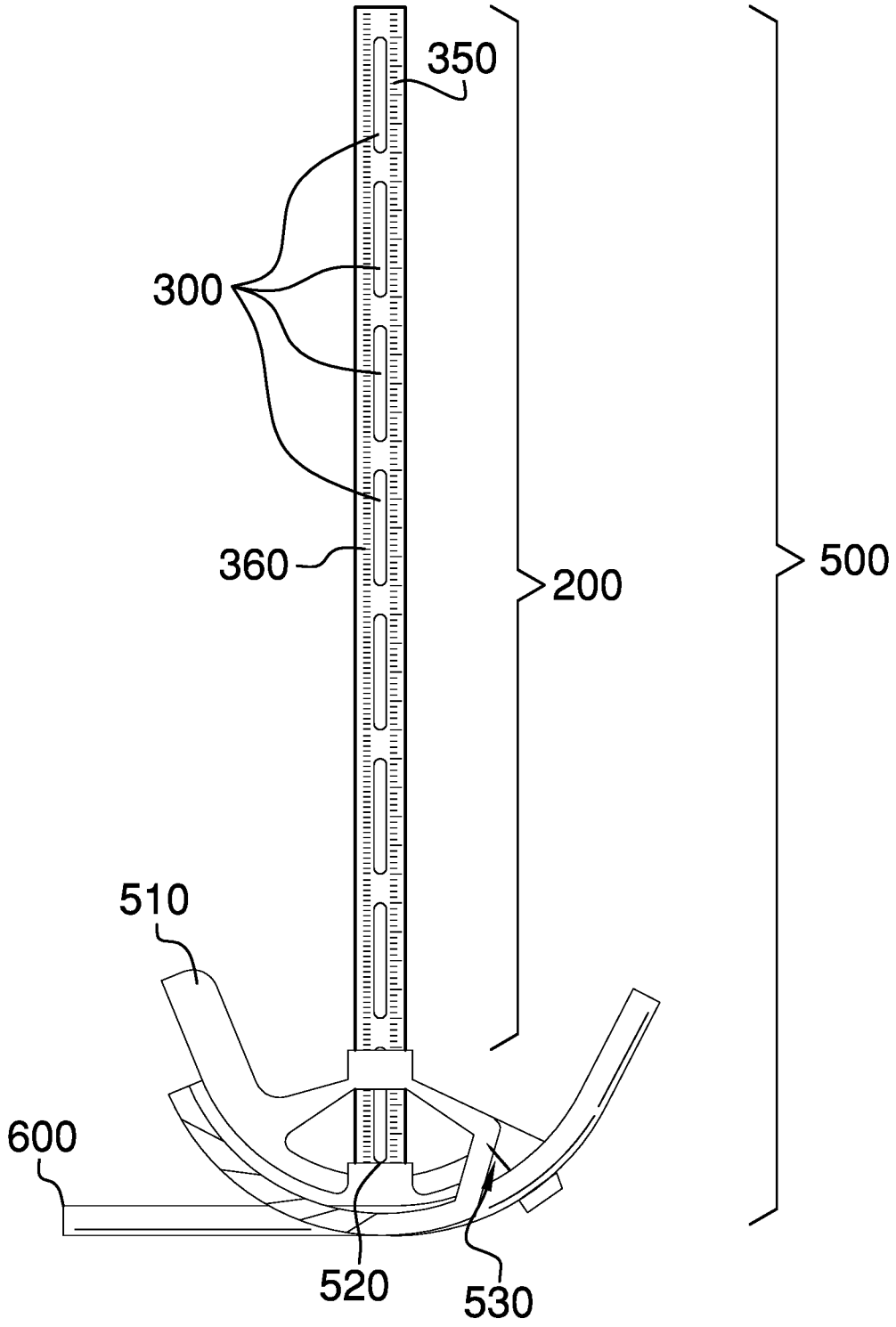
FIG. 5 is a side view of an embodiment of the disclosure illustrating the invention in use.
Figure 6A:
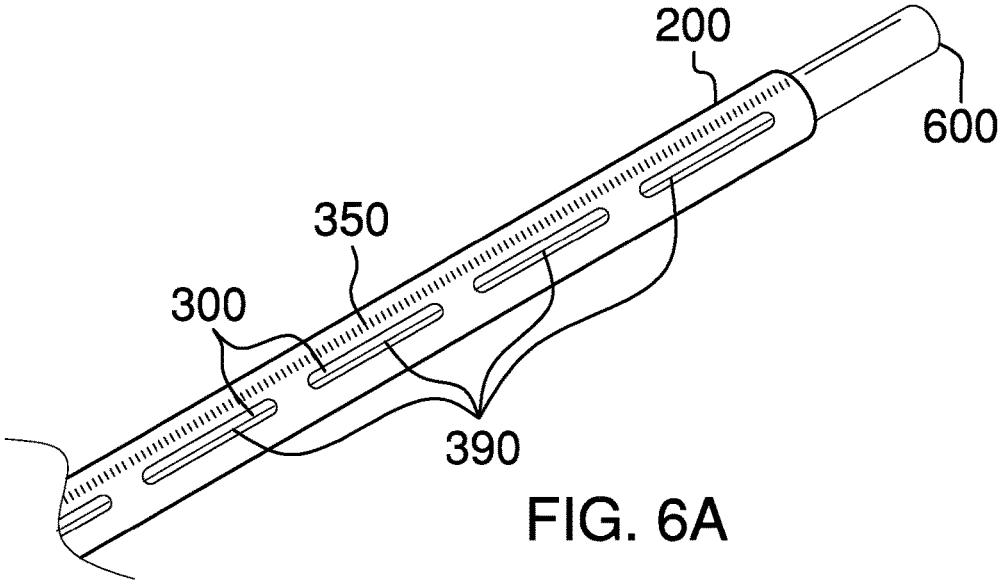
FIG. 6A is a detail view of an embodiment of the disclosure during the first step of making a longitudinal sight line mark on a piece of conduit.
Figure 6B:
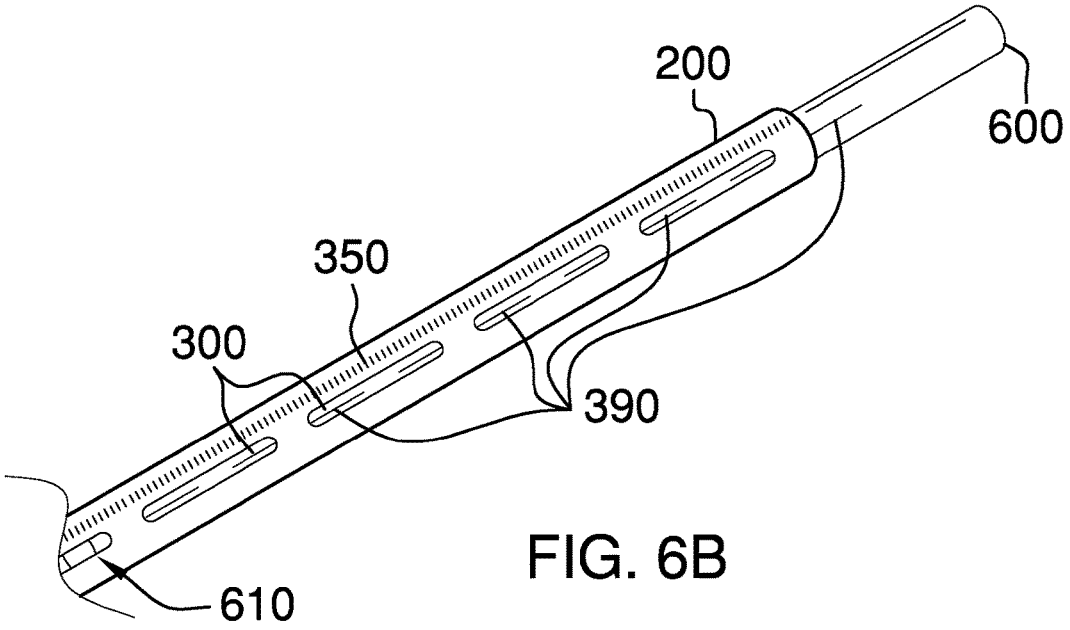
FIG. 6B is a detail view of an embodiment of the disclosure during the second step of making a longitudinal sight line mark on a piece of conduit.
Figure 7:
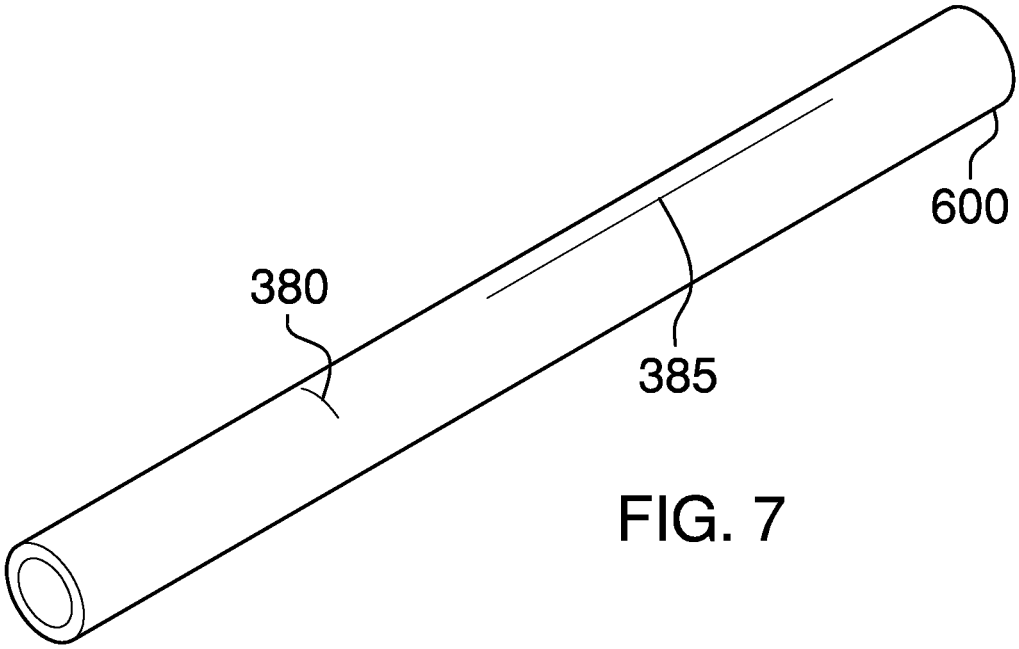
FIG. 7 is a perspective view of a piece of conduit with lateral and longitudinal marks made on it consistent with embodiments of the disclosure.
Figure 8:
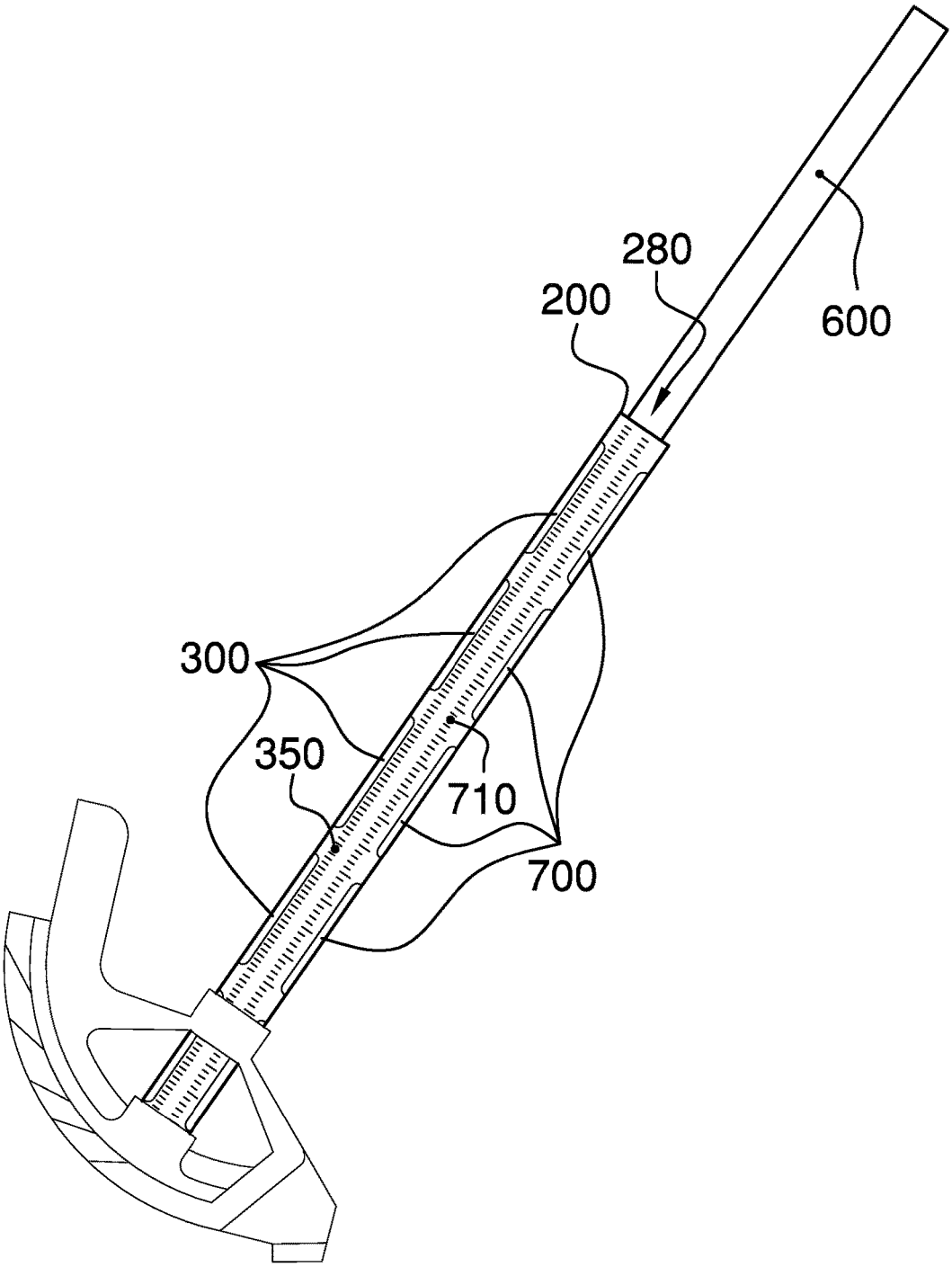
FIG. 8 is a detail view of a measuring handle with an alternative set of slots and an alternative measuring scale consistent with embodiments of the invention.

Detailed reference will now be made to a first potential embodiment of the disclosure, which is illustrated in FIGS. 1 through 8.

The conduit marking device 100 (hereinafter invention) comprises a measuring handle 200 for a conduit bender 500. The measuring handle 200 comprises a hollow metal tube with one or more slots 300 located longitudinally 250 along a side of the measuring handle 200. The invention 100 further comprises an integral measuring scale 350 oriented longitudinally 250 on the side of the measuring handle 200, and adjacent to the one or more slots 300. The integral measuring scale 350 comprises a set of markings on the side of the measuring handle 200. The nature of the markings is such that they are predictably spaced and can serve as reference points for a linear measurement. As non-limiting examples, the integral measuring scale 350 may comprise molded projections or molded indentations of the material making up the measuring handle 200 or they may be stamped into the measuring handle 200. In some embodiments, the markings that comprise the integral measuring scale 350 may be printed to improve their readability. In some embodiments, the integral measuring scale 350 may be accurate to within 1/16 inch.

The measuring handle 200 may comprise a measuring handle threaded end 210 to facilitate coupling of the measuring handle 200 to a conduit bending head 510, including the possibility that the measuring handle 200 may replace an existing handle of the conduit bending head 510. The measuring handle threaded end 210 may be a male thread.

A straight piece of conduit 600 may be inserted into an open end 280 of the measuring handle 200 where it will show through the one or more slots 300 in the measuring handle 200. The straight piece of conduit 600 may be pushed into the measuring handle 200 until an end of the conduit 610 is aligned with a first specific value 370 on the integral measuring scale 350. The first specific value 370 may be calculated via an electrician, based upon their knowledge of the conduit diameter, degree and type of bend, desired stub length, and other parameters of the conduit installation. When the end of the conduit 610 is aligned with the first specific value 370 on the integral measuring scale 350, a lateral mark 380 may be made on the straight piece of conduit 600 using a pencil, permanent ink marker, or other marking device. Depending upon the specifics of the measurement, the lateral mark 380 may be made on the straight piece of conduit 600 where the straight piece of conduit 600 enters the open end 280 of the measuring handle 200 or the lateral mark 380 made be made on the straight piece of conduit 600 through the one or more slots 300 at a second specific value 375 along the integral measuring scale 350. In some embodiments, the values used on the integral measuring scale 350 start at zero at the open end 280 of the measuring handle and increase as the integral measuring scale 350 moves along a length 450 of the measuring handle 200 towards the measuring handle threaded end 210.

In some embodiments, the straight piece of conduit 600 may be inserted into the measuring handle 200 until it will move no farther, that is, until the straight piece of conduit 600 is pushed against the measuring handle threaded end 210, and then the lateral mark 380 may be made on the straight piece of conduit 600 at the first specific value 370. In some embodiments, the values used on the integral measuring scale 350 may start at zero at the measuring handle threaded end 210 and increase as the integral measuring scale 350 moves along the length 450 of the measuring handle 200 towards the open end 280 of the measuring handle. In some embodiments, the measuring handle 200 may provide the integral measuring scale 350 that runs from zero at the open end 280 and a second measuring scale 360 that runs from zero at the measuring handle threaded end 210 thus allowing the straight piece of conduit 600 to be measured from either end of the measuring handle 200.

The measuring handle 200 may be coupled to the conduit bending head 510 by screwing the measuring handle threaded end 210 into a handle attachment point 520 of the conduit bending head 510.

In some embodiments, the invention 100 comprises a single handle segment comprising the measuring handle 200, and having a length of 3 ft to 5 ft with the one or more slots 300 and the integral measuring scale 350. In some embodiments, the invention 100 comprises two handle segments coupled end-to-end where one handle segment is the measuring handle 200 having a length of 1.5 to 4 ft with the one or more slots 300 and the integral measuring scale 350.

Frequently, the straight piece of conduit 600 must be bent to match an offset in the building structure. As previously mentioned, an offset requires that the straight piece of conduit 600 be bent twice in opposite directions by the same angular distance. Because two bends are required, there is a possibility that the conduit may rotate after the first bend and the resulting offset bend may not keep the conduit in a single plane. Such a pair of non-coplanar offset bends are often referred to as 'dog legs' and are undesirable. The invention 100 can help prevent dog legs by allowing a longitudinal mark 385 to be made on the side of the straight piece of conduit 600. The longitudinal mark 385 can be used as a sight-line when making offset bends and can help keep the bends in the same plane. To make the longitudinal mark 385 using the invention 100, the straight piece of conduit 600 is inserted into the measuring handle 200 and the longitudinal mark 385 is made as a series of line segments 390 drawn using a long side of the one or more slots 300 (see FIG. 6A). The longitudinal mark 385 thus formed will be incomplete due to gaps arising from the portions of the measuring handle 200 between consecutive slots of the one or more slots 300, however such an incomplete line is still usable as a sight-line. To complete the longitudinal mark 385, the straight piece of conduit 600 may then be partially withdrawn from the measuring handle 200 while keeping the lines already drawn aligned with a long side 240 of the one or more slots 300 (see FIG. 6B). When the gaps between lines are exposed, additional lines may be drawn using the long side 240 of the one or more slots 300 to complete the longitudinal mark 385 by joining the series of line segments 390.

In some instances a scale other than the one marked on the integral measuring scale 350 may be needed. As a non-limiting example, this may occur if the measuring handle 200 must accommodate a difference in conduit diameter, material, other physical characteristics or a different type of bend. In some embodiments, the invention 100 may provide an alternative set of slots 700 and an alternative measuring scale 710 on a different longitudinal side of the measuring handle 200. The alternative measuring scale may be adjacent to the alternative set of slots. As a non-limiting example, the measuring handle 200 may provide the alternative set of slots 700 and the alternative measuring scale 710 on the longitudinal side of the measuring handle 200 that is opposite the integral measuring scale 350.

In some embodiments, the measuring handle 200 may be provided with a rubberized grip 290. The rubberized grip 290 on the measuring handle 200 may comprise a rubbery surface surrounding the measuring handle 200 with cutout portions to allow viewing of the one or more slots 300 and the integral measuring scale 350. In some embodiments, the integral measuring scale 350 may be printed or stamped onto the rubberized grip 290.

In use, the invention 100 is installed on the conduit bender 500 by first unscrewing an existing handle from the conduit bending head 510. Next, the measuring handle 200 is coupled to the conduit bending head 510 by screwing the measuring handle threaded end 210 into the handle attachment point 520 on the conduit bending head 510. After analyzing the conduit diameter, type of conduit, and the desired length of a stub or offset, the electrician calculates the first specific value 370 for the placement of an arrow 530 on the conduit bending head 510. The electrician inserts the straight piece of conduit 600 into the open end 280 of the measuring handle 200 and slides the straight piece of conduit 600 into the measuring handle 200 until the end of the straight piece of conduit 600 is aligned with the first specific value 370 on the integral measuring scale 350.

The electrician then makes the lateral mark 380 on the straight piece of conduit 600 at the open end 280 of the measuring handle 200. The straight piece of conduit 600 may then be withdrawn from the measuring handle 200 and the conduit bending head 510 may be placed on the straight piece of conduit 600 such that the arrow 530 on the conduit bending head 510 is aligned with the lateral mark 380. The measuring handle 200 of the conduit bender 500 may then be pulled through a 90° bend. For offsets, the usage of the invention 100 would be similar except that two measurements would be made using the measuring handle 200 and the lateral mark 380 would be made twice on the straight piece of conduit 600, once for each measurement. For offsets, the electrician might also make a longitudinal sight line in the manner that was previously described.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A conduit marking device comprising:

a measuring handle for a conduit bender, and an integral measuring scale;

wherein the measuring handle comprises a hollow metal tube;

wherein the measuring handle comprises one or more slots located longitudinally along a side of the measuring handle;

wherein the integral measuring scale comprises a set of markings oriented longitudinally on the side of the measuring handle;

wherein the markings comprising the integral measuring scale are predictably spaced and serve as reference points for a linear measurement;

wherein the integral measuring scale is adjacent to the one or more slots;

wherein the measuring handle comprises a measuring handle threaded end to facilitate coupling of the measuring handle to a conduit bending head;

wherein the measuring handle threaded end is a male thread;

wherein the measuring handle couples to the conduit bending head by screwing the measuring handle threaded end into a handle attachment point on the conduit bending head.

2. The conduit marking device according to claim 1 wherein the markings comprising the integral measuring scale are molded into the measuring handle.

3. The conduit marking device according to claim 1 wherein the markings comprising the integral measuring scale are stamped into the measuring handle.

4. The conduit marking device according to claim 1 wherein the markings that comprise the integral measuring scale are printed onto the measuring handle.

5. The conduit marking device according to claim 1 wherein the integral measuring scale are accurate to within 1/16 inch.

6. The conduit marking device according to claim 1 wherein a straight piece of conduit is inserted into an open end of the measuring handle shows through the one or more slots in the measuring handle;

wherein the straight piece of conduit is pushed into the measuring handle until an end of the conduit is aligned with a first specific value on the integral measuring scale;

wherein a lateral mark is made on the straight piece of conduit using a marking device.

7. The conduit marking device according to claim 6 wherein the lateral mark is made at the point where the straight piece of conduit enters the open end of the measuring handle.

8. The conduit marking device according to claim 6 wherein the lateral mark is made on the straight piece of conduit through the one or more slots at a second specific value along the integral measuring scale.

9. The conduit marking device according to claim 6 wherein the integral measuring scale starts at zero at the open end of the measuring handle and increase as the integral measuring scale moves along a length of the measuring handle towards the measuring handle threaded end.

10. The conduit marking device according to claim 1 wherein a straight piece of conduit is inserted into an open end of the measuring handle shows through the one or more slots in the measuring handle;

wherein the straight piece of conduit is inserted into the measuring handle until it is pushed against the measuring handle threaded end;

wherein the lateral mark is made on the straight piece of conduit at the first specific value.

11. The conduit marking device according to claim 10 wherein the integral measuring scale starts at zero at the measuring handle threaded end and increase as the integral measuring scale moves along the length of the measuring handle towards the open end of the measuring handle.

12. The conduit marking device according to claim 1 wherein the measuring handle comprises the integral measuring scale that runs from zero at the open end of the measuring handle and increase as the integral measuring scale moves along a length of the measuring handle towards the measuring handle threaded end;

wherein the measuring handle comprises a second measuring scale that runs from zero at the measuring handle threaded and increase as the integral measuring scale moves along the length of the measuring handle towards the open end of the measuring handle.

13. The conduit marking device according to claim 12 wherein a longitudinal mark is made as a series of line segments drawn using a long side of the one or more slots;

wherein the longitudinal mark is useful as a sight-line for aligning multiple bends.

14. The conduit marking device according to claim 13 further comprising an alternative set of slots, and an alternative measuring scale;

wherein the alternative set of slots is located on a different longitudinal side of the measuring handle than the one or more slots;

wherein the alternative measuring scale is located on a different longitudinal side of the measuring handle than the integral measuring scale;

wherein the alternative measuring scale is adjacent to the alternative set of slots.

15. The conduit marking device according to claim 14 wherein the measuring handle comprises a rubberized grip.

* * * * *